US008651610B2

(12) United States Patent
Sethne et al.

(10) Patent No.: US 8,651,610 B2
(45) Date of Patent: Feb. 18, 2014

(54) IMAGE FORMING SYSTEM AND METHODS THEREOF

(75) Inventors: Yngvar Rossow Sethne, Sant Cugat del Valles Barcelona (ES); Utpal Kumar Sarkar, Sabadell Barcelona (ES); Marcos Casaldaliga Albisu, Sant Cugat del Valles (ES); Jesús Garcia Maza, Terrassa Barcelona (ES); Marina Ferran Farrés, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 368 days.

(21) Appl. No.: 13/032,875

(22) Filed: Feb. 23, 2011

(65) Prior Publication Data

US 2012/0212535 A1 Aug. 23, 2012

(51) Int. Cl.
*B41J 29/38* (2006.01)

(52) U.S. Cl.
USPC ..... 347/16

(58) Field of Classification Search
USPC ..... 347/15, 16, 9, 14, 19
See application file for complete search history.

(56) References Cited

U.S. PATENT DOCUMENTS 6,454,474 B1 9/2002 Lesniak et al.
6,641,242 B2 11/2003 Canti et al.
6,698,861 B1 3/2004 Drake
7,036,904 B2 5/2006 King et al.
7,431,522 B2 10/2008 Linville et al.
7,537,334 B2 5/2009 Yang et al.
7,543,927 B2 6/2009 Campillo et al.
7,845,751 B2 12/2010 Rueby
2002/0130914 A1 * 9/2002 Mantell et al. ..... 347/15
2003/0058295 A1 3/2003 Heiles et al.
2003/0132979 A1 7/2003 Taylor
2005/0146548 A1 7/2005 De Pena et al.
2010/0309242 A1 12/2010 Chikuma
2011/0012949 A1 1/2011 Enge

FOREIGN PATENT DOCUMENTS

JP 2011189729 A 9/2011

OTHER PUBLICATIONS

Extended EP Search Report ~ Application No. 12156732.5-1251 dated Jul. 5, 2012 ~ 6 pages.

* cited by examiner

*Primary Examiner* — Manish S Shah
*Assistant Examiner* — Yaovi Ameh

(57) ABSTRACT

An image forming system includes a print unit to print a plurality of swaths to form an image on a media, a media transport unit to transport the media to the print unit and an advancement error determination unit to determine an amount of advancement error corresponding to the transportation of the media. The image forming system also includes a swath adjustment module to dynamically adjust a swath size of a respective swath.

20 Claims, 6 Drawing Sheets

IMAGE FORMING SYSTEM AND METHODS THEREOF

BACKGROUND

Image forming systems may include a print unit to print swaths on media to form images and a media transport unit to transport the media to the print unit. The printed images may include distortions due to artifacts and/or banding based on respective advancement errors corresponding to the transportation of the media. Such image forming systems may include inkjet printing systems.

BRIEF DESCRIPTION OF THE DRAWINGS

Non-limiting examples are described in the following description, read with reference to the figures attached hereto and do not limit the scope of the claims. Dimensions of components and features illustrated in the figures are chosen primarily for convenience and clarity of presentation and are not necessarily to scale. Referring to the attached figures:

DETAILED DESCRIPTION

Image forming systems may include a print unit to print swaths on media to form images thereon and a media transport unit to transport the media to the print unit. The printed images may include distortions due to artifacts and/or banding based on respective advancement errors due to the transportation of the media. Image forming systems may attempt to reduce such distortions by using historical advancement error data to correct subsequent transportation of the media by the media transport unit. For example, a media advancement sensor may be used to obtain data to attempt to predict a subsequent advancement error using historical advancement error data and adjust the subsequent transportation of the media for cyclical errors in accordance with the prediction. Also, a media advancement sensor may provide feedback to the media transport unit during the media transportation to be used to provide additional adjustments to the respective position of the media with respect to the print unit. The attempted correction of subsequent advancements of the media by the media transport unit based on historical advancement error data, however, may not properly compensate for non-cyclical errors such as media subjected to thermal deformation, or the like, prior to the respective media advancement and/or may slow down throughput of the image forming system.

In examples of the present disclosure, the image forming system includes, amongst other things, an advancement error determination unit to determine an amount of advancement error corresponding to the transportation of the media and a swath adjustment module to dynamically adjust a swath size of a respective swath to form an adjusted swath and dynamically apply a masked out portion to the adjusted swath at least based on the determined amount of advancement error. Further, the adjusted swath is printed on the media having an effective swath height to minimize potential gaps and overlaps between adjacent swaths due to advancement errors. Accordingly, the dynamic adjustment of a swath size and the dynamic application of the masked out portion based on at least the determined amount of advancement error may properly compensate for media subjected to thermal deformation, or the like, prior to the respective media advancement. The dynamic adjustment of a swath size and the dynamic application of the masked out portion based on at least the determined amount of advancement error may also reduce the potential slowing down of the throughput of the image forming system.

Figure 1:
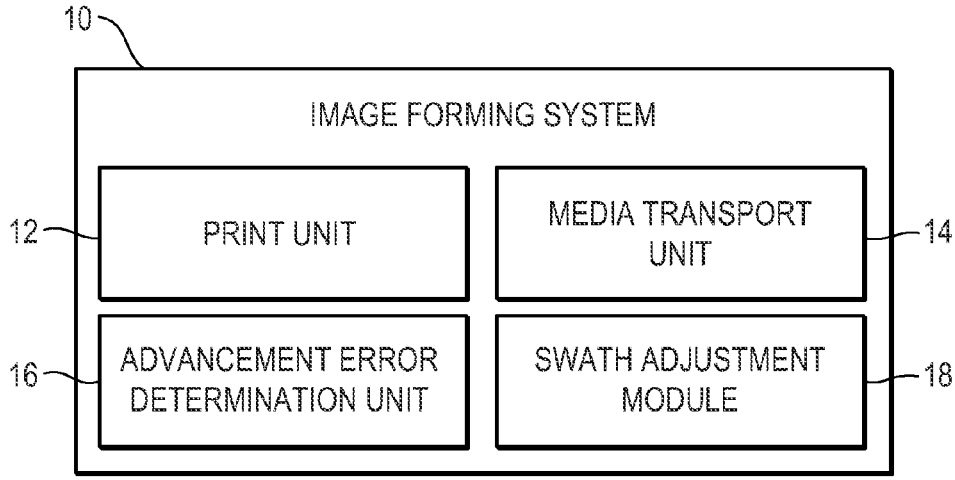
FIG. 1 is a block diagram illustrating an image forming system according to an example.
Figure 3:
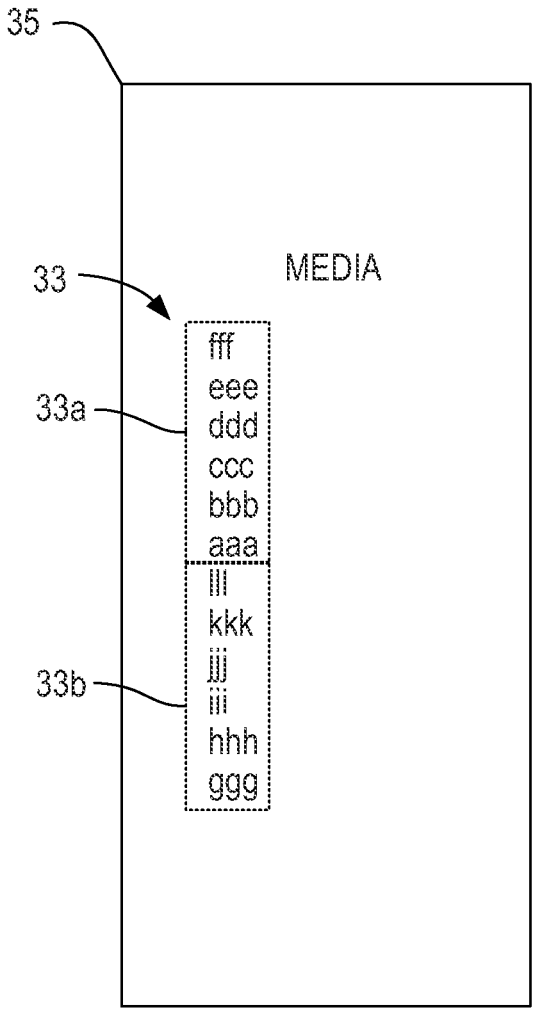
FIG. 3 is a representational diagram illustrating an adjacent swath set printed on a media by the image forming system of FIG. 1 according to an example.
Figure 4A:
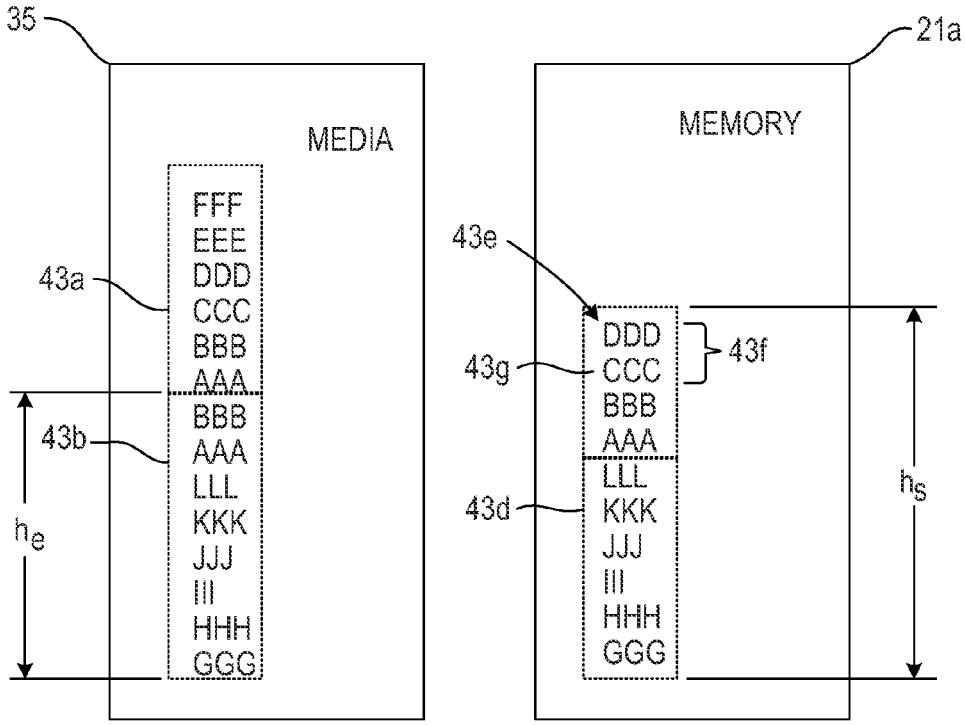
FIGS. 4A, 4B and 4C are representational diagrams illustrating the printing and/or adjusting of swaths corresponding to respective advancement states of the media by the image forming systems of FIGS. 1 and 2 according to examples.
Figure 4B:
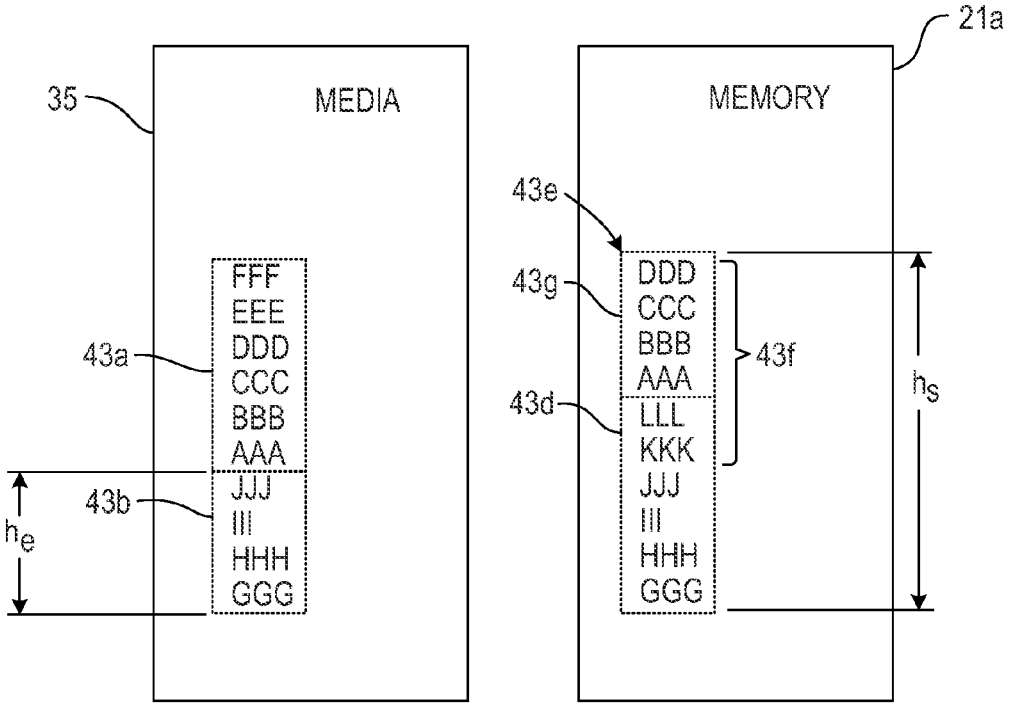
Figure 4C:
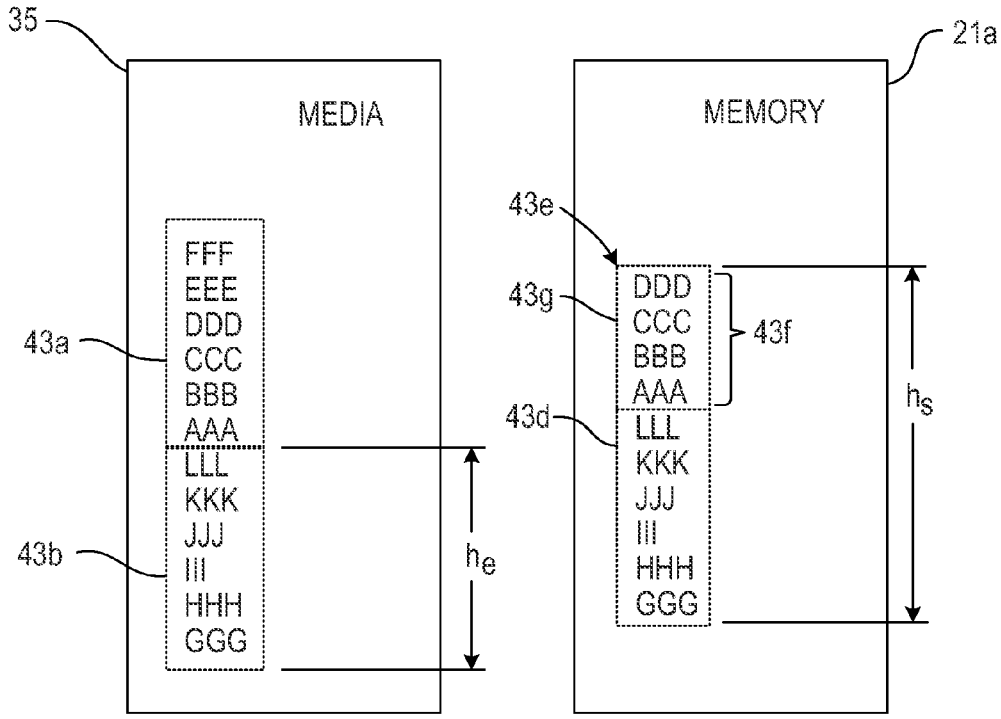

FIG. 1 is a block diagram illustrating an image forming system according to an example. FIG. 3 is a representational diagram illustrating an adjacent swath set printed on a media by the image forming system of FIG. 1 according to an example. Referring to FIGS. 1 and 3, in the present example, an image forming system 10 includes a print unit 12, a media transport unit 14, an advancement error determination unit 16, and a swath adjustment module 18. The print unit 12 prints swaths 33*a* and 33*b* of an adjacent swath set 33 to form an image on a media 35. The printed swaths 33*a* and 33*b* may be in a form of one or more of a preceding printed unadjusted swath 43*a* (FIGS. 4A-4C) and a subsequently printed adjusted swath 43*b* (FIGS. 4A-4C).

Referring to FIGS. 1 and 3, the media transport unit 14 transports the media 35 to the print unit 12. The advancement error determination unit 16 determines an amount of advancement error corresponding to the transportation of the media 35. The swath adjustment module 18 dynamically adjusts a swath size of a respective swath 43*d* and dynamically applies a masked out portion 43*f* based on at least the determined amount of advancement error as illustrated in FIG. 4A (e.g., over-advancement state), FIG. 4B (e.g., under-advancement state) and FIG. 4C (e.g., correct advancement state). The amount of advancement error may correspond to a difference in an amount between a requested position for the media 35 to be placed and a measured position in which the media 35 is placed. An over-advancement state corresponds to a state in which the respective media 35 is undesirably transported past the print unit 12. In the over-advancement state, for example, the amount of advancement error may be a positive number. An under-advancement state corresponds to a state in which the respective media 35 is undesirably transported short of the print unit 12. In the under-advancement state, for example, the amount of advancement error may be a negative number. A correct advancement state corresponds to a state in which the respective media 35 is properly transported to the print unit 12. In the correct advancement state, for example, the amount of advancement error may be zero.

Figure 2:
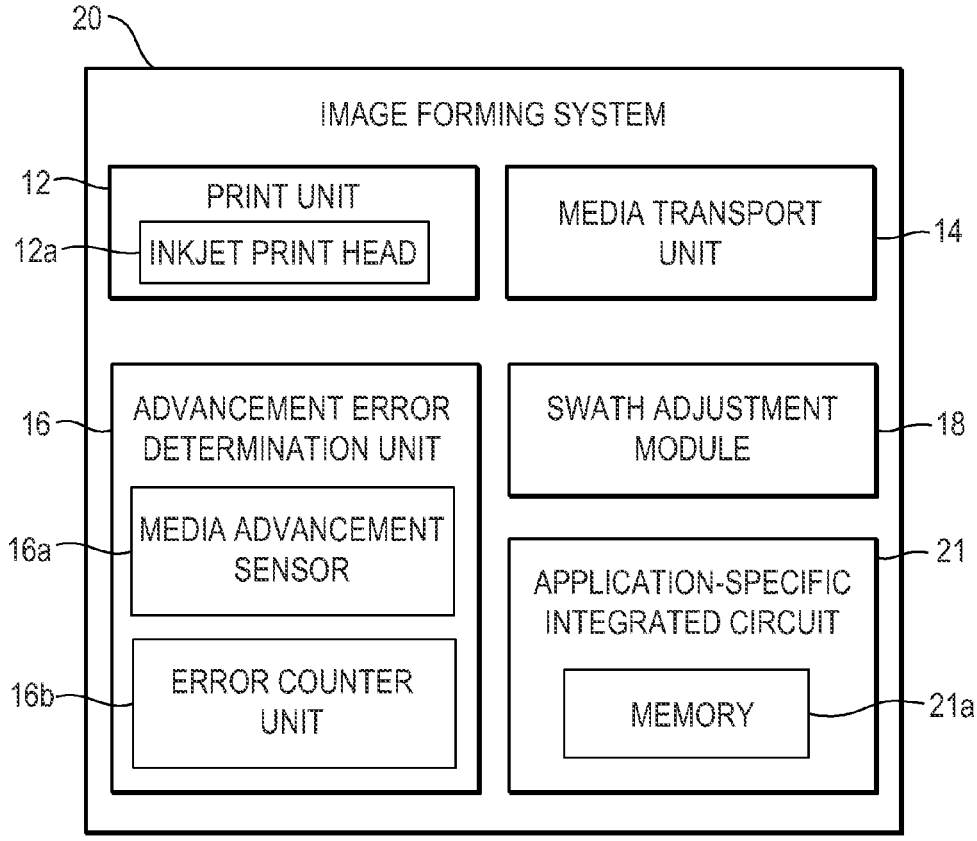
FIG. 2 is a block diagram illustrating the image forming system of FIG. 1 according to another example.

FIG. 2 is a block diagram illustrating the image forming system of FIG. 1 according to another example. The image forming system 20 illustrated in FIG. 2 includes the print unit 12, the media transport unit 14, the advancement error determination unit 16, and the swath adjustment module 18 previously disclosed with reference to FIG. 1. In examples, the image forming system 10 and 20 may be an inkjet printing system and/or a digital copier, printer, bookmaking machine, facsimile machine, multi-function machine, or the like. Referring to FIGS. 2 and 3, in the present example, the print unit 12 includes an inkjet print head 12*a*, for example, to print swaths 33*a* and 33*b* on the media 35 with fluid to form images thereon. The fluid may include ink or other types of fluids. The term ink is used generally herein, and encompasses any type of pigment or colorant such as toner, or other type of image forming material, and may be in a variety of forms such as liquid, semi-liquid, dry, powder, solid, semi-solid, or other forms that is used by image forming systems 10 and 20.

Referring to FIGS. 2 and 3, in the present example, the print unit 12, such as an inkjet print head 12*a*, may be disposed in a movable carriage (not illustrated) to move across the media 35. The carriage may move the inkjet print head 12*a* across the media 35 in a primary pass to print a preceding swath 33*a* of a respective adjacent swath set 33 on the media 35. Subsequently, the carriage may move the inkjet print head 12*a* across the media 35 in a secondary pass to print a subsequent swath 33*b* of the adjacent swath set 33 adjacent to the preceding swath 33*a* on the media 35. In examples, the subsequent swath 33*b* may be in the form of a subsequently printed adjusted swath 43*b* (FIGS. 4A-4C). Alternatively, in an example, the print unit 12 may include a stationary inkjet print head 12*a* that does not reciprocate across the media 35. In the present example, the image forming system 20 of FIG. 2 also includes an application-specific integrated circuit (ASIC) 21 including a memory 21*a*. In examples, the memory 21*a* may also include local memory such as non-volatile and volatile memory, firmware and the like, and/or non-local memory in communication with the image forming system 10 and 20, for example, wirelessly and/or through a network.

Referring to FIGS. 1 and 2, in examples, the advancement error determination unit 16 and/or the swath adjustment module 18 may be implemented in hardware, software, or in a combination of hardware and software. In other examples, the advancement error determination unit 16 and/or the swath adjustment module 18 may be implemented in whole or in part as a computer program including machine-readable instructions stored in the image forming system 10 and 20 locally or remotely, for example, in a memory such as a server or a host computing device considered herein to be part of the image forming system 10 and 20. In an example, the advancement error determination unit 16 may include at least one media advancement sensor 16*a* to detect the advancement error of the media 35 and at least one error counter unit 16*b* to count the amount of the advancement error.

In an example, the advancement error determination unit 16 may also include machine-readable instructions to determine an amount of the advancement error. In examples, the advancement error determination unit 16 may determine the actual amount of advancement error based on a number of rows in which the media 35 was over advanced or under advanced. For example, in the over-advancement state, the number of rows in which the media 35 was over advanced may be represented as a positive number. Alternatively, in the under-advancement state, the number of rows in which the media 35 was under-advanced may be represented as a negative number. The swath adjustment module 18 may include machine-readable instructions to receive the amount of advancement error determined from the advancement error determination unit 16. The swath adjustment module 18 may also include machine-readable instructions to adjust a swath height $h_s$ to form an adjusted swath 43*e* in memory 21*a*, determine a respective masked out portion 43*f* to be applied to the adjusted swath 43*e* (FIGS. 4A-4C) in the memory 21*a* based on at least the determined amount of advancement error, print the adjusted swath with an effective swath height $h_e$ based on at least the determined amount of advancement error. The swath height $h_s$ corresponds to a height of a respective adjusted swath 43*e* in memory. The effective swath height $h_e$ corresponds to a swath height of the subsequently printed adjusted swath 43*b* printed on the media 35. Accordingly, adjusting the effective swath height $h_e$ of the subsequently printed adjusted swaths 43*b* enables the printing of adjacent swaths 43*a* and 43*b* in a manner that minimizes unintended overlap due to an under-advancement state and unintended gaps due to an over-advancement state.

FIG. 4A is a representational diagram illustrating swath adjustment in memory and printing of adjacent swaths on media corresponding to an over-advancement state by the image forming system of FIG. 1 according to an example. FIG. 4B is a representational diagram illustrating swath adjustment in memory and printing of adjacent swaths on media corresponding to an under-advancement state by the image forming system of FIG. 1 according to an example. FIG. 4C is a representational diagram illustrating printing of adjacent swaths on media corresponding to a correct advancement state by the image forming system of FIG. 1 according to an example. Referring to FIGS. 1-4C, in examples, the swath adjustment module 18 dynamically adjusts a size of the respective swath by increasing a swath height $h_s$ of the respective swath 43*d* in memory 21*a* to form an adjusted swath 43*e* and dynamically applies a masked out portion 43*f* to the adjusted swath 43*e* based on at least the amount of advancement error.

In the present example, the masked out portion 43*f* may be based on at least the predetermined size of the buffer region 43*g* and the determined amount of advancement error. The swath adjustment module 18 may dynamically increase the swath height $h_s$ of the respective swath 43*d* in memory 21*a* by forming a buffer region 43*g* having a predetermined size thereto to form the adjusted swath 43*e*. Referring to FIGS. 4A-4C, the buffer region 43*g*, for example, may include a lower portion of a corresponding preceding swath 43*a* duplicated as an upper portion of the adjusted swath 43*e* in a form of a plurality of rows (e.g., AAA, BBB, etc). In the present example, the buffer region 43*g* may have a predetermined size such as a predetermined number of rows.

In FIGS. 4A-4C, for illustrative purposes, the predetermined number of rows of the buffer region 43*g* is four. Consequently, the buffer region 43*g* includes four rows of the lower portion of the corresponding preceding printed swath 43*a* (e.g., AAA, BBB, CCC, and DDD). In an example, the masked out portion 43*f* may be based on at least the determined amount of advancement error. In the present example, the masked out portion 43*f* may be based on the predetermined size of the buffer region and the determined amount of advancement error. For example, the masked out portion 43*f* may correspond to a calculated number of rows of, for example, the upper portion of the buffer region 43*g* and/or adjusted swath 43*e* such that the calculated number of rows are equal to the number of predetermined rows of the buffer region 43*g* minus the number of rows of the advancement error.

For illustrative purposes, FIG. 4A illustrates an over-advancement state in which the advancement error is two rows. Referring to FIG. 4A, compensation for an over-advancement of two rows (e.g., advancement error of two) results in the masked out portion 43*f* of the adjusted swath 43*e* including two rows (e.g., CCC and DDD) as a result of the two upper rows of the adjusted swath 43*e* and/or buffer region 43*g* being subtracted from the four predetermined number of rows corresponding to the buffer region 43*g* (e.g., AAA-DDD) according to an example. The print unit 12 subsequently prints the printed adjusted swath 43*b* on the media 35 adjacent to and after the print unit 12 prints the corresponding preceding swath 43*a* on the media 35.

Consequently, the printed adjusted swath 43*b* has an effective swath height $h_e$ including eight rows (e.g., GGG-BBB) and does not include the corresponding masked out portion 43*f*. Accordingly, when the determined amount of the advancement error is greater than zero, a size of the masked out portion 43*f* is less than the predetermined size of the buffer region 43*g*. In an example, the size of which the masked out portion 43*f* is less than the predetermined size of the buffer region 43*g* may be equal to an amount of the determined amount of advancement error. Thus, compensation for the over-advancement state provided in accordance with examples of the present disclosure enables the printing of adjacent swaths 43*a* and 43*b* in a manner to minimize an unintended gap region therebetween.

FIG. 4B is a representational diagram illustrating swath adjustment in memory and printing of adjacent swaths on media corresponding to an under-advancement state by the image forming system of FIG. 1 according to an example. For illustrative purposes, FIG. 4B illustrates an under-advancement state in which the advancement error is two rows. Referring to FIG. 4B, compensation for an under-advancement of two rows (e.g., advancement error of negative two) results in the masked out portion 43*f* of the respective swath 43*d* including six rows (e.g., KKK-DDD) of the adjusted swath 43*e* according to an example. The print unit 12 subsequently prints the printed adjusted swath 43*b* on the media 35 adjacent to and after the print unit 12 prints the corresponding preceding swath 43*a* on the media 35.

Consequently, the subsequently printed adjusted swath 43*b* has an effective swath height $h_e$ including four rows (e.g., GGG-JJJ) and does not include the respective six rows (e.g., masked out portion 43*f*) as illustrated in FIG. 4B. Referring to FIG. 4B, when the determined amount of the advancement error is less than zero, a size of the masked out portion 43*f* is greater than the predetermined size of the buffer region 43*g*. In an example, the size by which the masked out portion 43*f* is greater than the predetermined size of the buffer region 43*g* may be equal to an absolute value of an amount of the determined amount of advancement error. Thus, compensation for the under-advancement state provided in accordance with examples of the present disclosure enables adjacent swaths 43*a* and 43*b* to be printed in a manner to minimize an unintended overlapped region resulting in an increase of fluid density therein.

FIG. 4C is a representational diagram illustrating printing of adjacent swaths on media corresponding to a correct advancement state by the image forming system of FIG. 1 according to an example. For illustrative purposes, FIG. 4C illustrates a correct advancement state in which the advancement error is zero rows (e.g., advancement error of zero). Referring to FIG. 4C, compensation for a correct advancement state results in the masked out portion 43*f* of the respective swath 43*d* including four rows (e.g., AAA-DDD) according to an example. The print unit 12 subsequently prints the printed adjusted swath 43*b* on the media 35 adjacent to and after the print unit 12 prints the corresponding preceding swath 43*a* on the media 35.

Consequently, the subsequently printed adjusted swath 43*b* has an effective swath height $h_e$ including six rows (e.g., GGG-LLL) and does not include the respective four rows (e.g., masked out portion 43*f*) as illustrated in FIG. 4C. Accordingly, when the determined amount of the advancement error is equal to zero, a size of the masked out portion 43*f* is equal to the predetermined size of the buffer region 43*g*. That is, the effective swath height $h_e$ of the printed adjusted swath 43*b* is equal to the height of the respective swath 43*d*. Thus, in the correct advancement state in accordance with examples of the present disclosure, adjacent swaths 43*a* and 43*b* may be printed on the media 35 minimizing an unintended overlapped region therein and an unintended gap therebetween.

Figure 5:
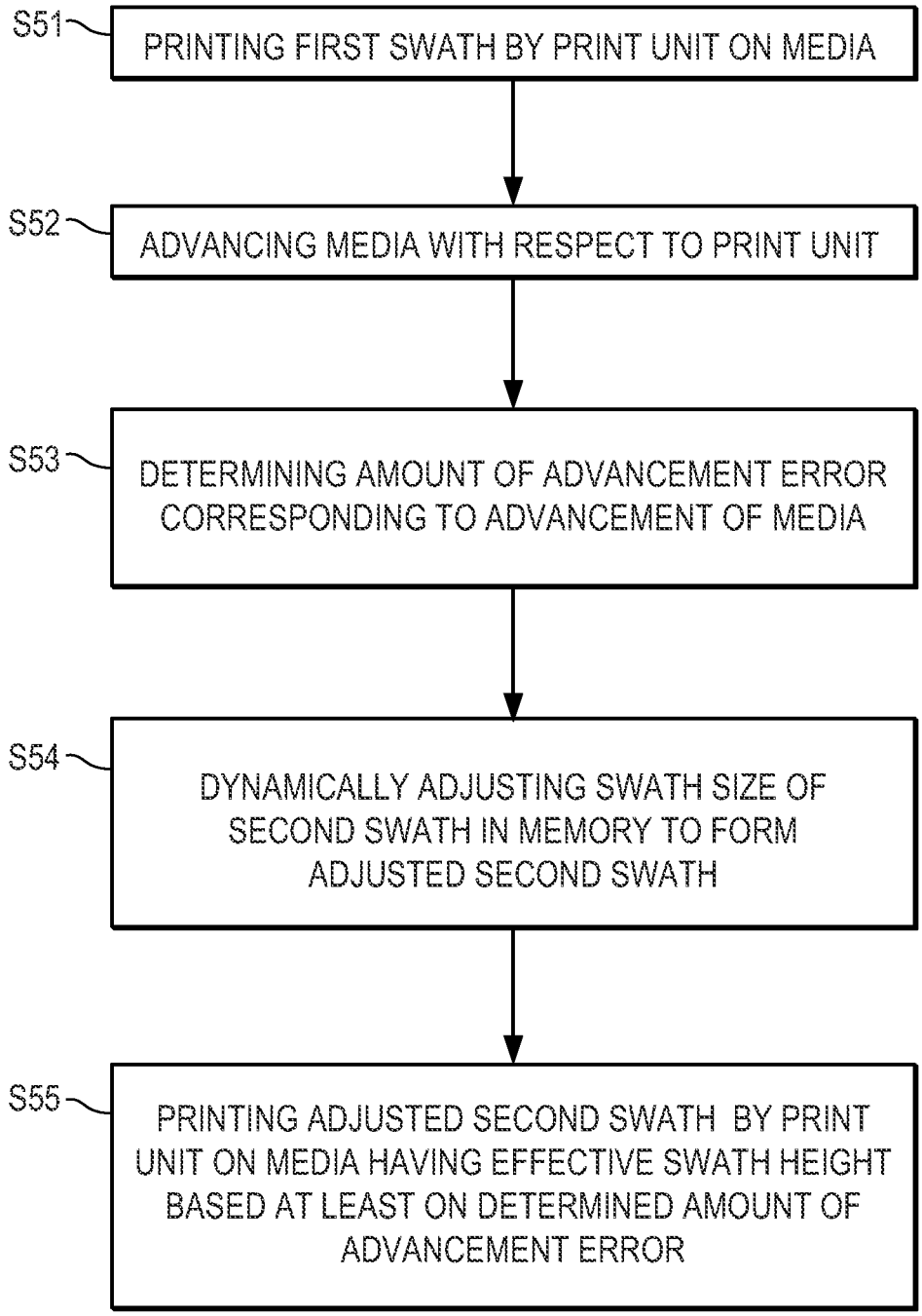
FIG. 5 is a flowchart illustrating a swath adjustment method according to an example.

FIG. 5 is a flowchart illustrating a swath adjustment method according to an example. Referring to FIG. 5, in block S51, a first swath is printed by a print unit on a media. In an example, the first swath may correspond to the preceding printed unadjusted swath as previously disclosed with respect to FIGS. 1-4C. In block S52, the media is advanced with respect to the print unit. In block S53, an amount of advancement error is determined corresponding to the advancement of the media. In block S54, a swath size of a second swath is dynamically adjusted in memory to form an adjusted second swath. In block S55, the adjusted second swath is printed by the print unit on the media having an effective swath height based on at least the determined amount of advancement error. In an example, the second swath and the adjusted second swath may correspond to the respective swath and the adjusted swath, respectively, as previously disclosed with respect to FIGS. 1-4C. The adjusted second swath may be subsequently printed on the media adjacent to and after the print unit prints the first swath on the media having an effective swath height based on at least the determined amount of advancement error.

In an example, in block S54, dynamically adjusting a swath size of a second swath in memory to form an adjusted second swath may include dynamically increasing a swath height of the second swath by forming a buffer region having a predetermined size to the second swath to form the adjusted second swath and dynamically applying a masked out portion to the adjusted second swath. Forming the buffer region may include duplicating a lower portion of the first swath of the predetermined size to an upper portion of the adjusted second swath in a form of a plurality of rows. The masked out portion may be based on the predetermined size of the buffer region and the determined amount of advancement error. For example, when the determined amount of the advancement error is less than zero, a size of the masked out portion may be greater than the predetermined size of the buffer region. That is, the size of the masked out portion may be greater than the predetermined size of the buffer region by an amount equal to an absolute value of the determined advancement error.

When the determined amount of the advancement error is greater than zero, a size of the masked out portion is less than the predetermined size of the buffer region. That is, the size of the masked out portion may be less than the predetermined size of the buffer region by an amount equal to the determined advancement error. Alternatively, when the determined amount of the advancement error is equal to zero, a size of the masked out portion is equal to the predetermined size of the buffer region. Printing the adjusted second swath by the print unit on the media may include subsequently printing the adjusted second swath on the media adjacent to and after the print unit prints the first swath on the media. The printed adjusted swath may have an effective swath height at least based on the determined amount of advancement error.

It is to be understood that the flowchart of FIG. 5 illustrates an architecture, functionality, and operation of an example of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowchart of FIG. 5 illustrates a specific order of execution, the order of execution may differ from that which is depicted. For example, the order of execution of two or more blocks may be scrambled relative to the order illustrated. Also, two or more blocks illustrated in succession in FIG. 5 may be executed concurrently or with partial concurrence. All such variations are within the scope of the present disclosure.

Figure 6:
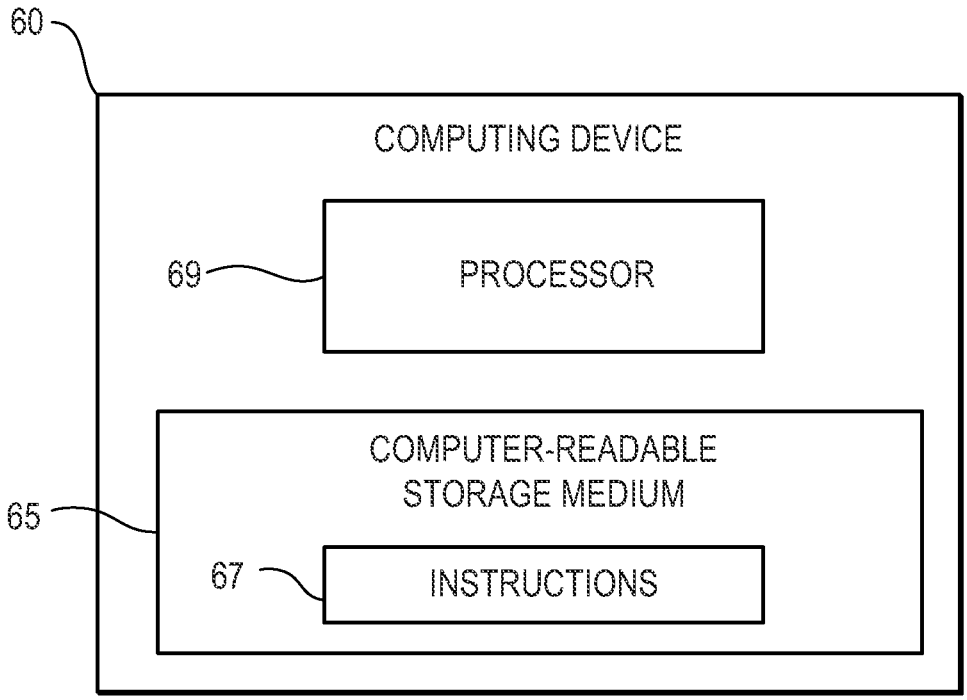
FIG. 6 is a block diagram of the swath adjustment method of FIG. 5 embodied in a computer-readable storage medium according to an example.

FIG. 6 is a block diagram of the swath adjustment method of FIG. 5 embodied in a computer-readable storage medium according to an example. Referring to FIG. 6, in examples, the present disclosure may be embodied in any computer-readable storage medium 65 for use by or in connection with an instruction-execution system, apparatus or device such as a computer/processor based system, processor 69 or other system (computing device 60) that can fetch the instructions from the instruction-execution system, apparatus or device, and execute the instructions 67 contained therein. In the context of this disclosure, a computer-readable storage medium 65 can be any means that can store, communicate, propagate or transport instructions 67 for use by or in connection with the computing device 60 such as an image forming system 10 and 20. The computer-readable storage medium 65 can include any one of many physical media such as, for example, electronic, magnetic, optical, electromagnetic, infrared, or semiconductor media.

More specific examples of computer-readable storage medium would include, but are not limited to, a portable magnetic computer diskette such as floppy diskettes or hard drives, a random access memory (RAM), a read-only memory (ROM), an erasable programmable read-only memory, or a portable compact disc. It is to be understood that the computer-readable storage medium 65 could even be paper or another suitable medium upon which the instructions 67 are printed, as the instructions 67 can be electronically captured, via, for instance, optical scanning of the paper or other medium, then compiled, interpreted or otherwise processed in a single manner, if necessary, and then stored therein. The computer-readable storage medium 65 includes instructions 67 executed, for example, by the processor 69 and, that when executed, cause the processor 69 and/or computing device 60 to perform some or all of the functionality described herein.

Those skilled in the art will understand that various examples of the present disclosure can be implemented in hardware, software, firmware or combinations thereof. Separate examples can be implemented using a combination of hardware and software or firmware that is stored in memory and executed by a suitable instruction-execution system. If implemented solely in hardware, as in an alternative example, the present disclosure can be separately implemented with any or a combination of technologies such as discrete-logic circuits, application-specific integrated circuits (ASICs), programmable-gate arrays (PGAs), field-programmable gate arrays (FPGAs), and/or other later developed technologies. In other examples, the present disclosure can be implemented in a combination of software and data executed and stored under the control of a computing device. Once given the above disclosure, many other features, modifications or improvements will become apparent to the skilled artisan. Such features, modifications or improvements are, therefore, considered to be a part of the present disclosure, the scope of which is to be determined by the following claims.

What is claimed is:

1. An image forming system, comprising:

a print unit to print a plurality of swaths to form an image on a media;

a media transport unit to transport the media to the print unit;

an advancement error determination unit to determine an amount of advancement error corresponding to the transport of the media; and a swath adjustment module to dynamically adjust a swath size of a respective swath to form an adjusted swath and dynamically apply a masked out portion to the adjusted swath based on at least the determined amount of advancement error, wherein when the determined amount of advancement error corresponds to an under-advancement state, the swath size of the respective swath is reduced, and wherein when the determined amount of advancement error corresponds to an over-advancement state, the swath size of the respective swath is increased.

2. The image forming system according to claim 1, wherein the swath adjustment module dynamically adjusts the swath size of the respective swath dynamically increasing a swath height of the respective swath by adding a buffer region having a predetermined size to the respective swath to form the adjusted swath, and dynamically applying the masked out portion to at least a portion of the increased swath height.

3. The image forming system according to claim 2, wherein the buffer region comprises:

a lower portion of a corresponding preceding swath having the predetermined size duplicated as an upper portion of the adjusted swath in a form of a plurality of rows.

4. The image forming apparatus according to claim 2, wherein the masked out portion is based on the predetermined size of the buffer region and the determined amount of advancement error.

5. The image forming system according to claim 4, wherein when the determined amount of advancement error corresponds to the under-advancement state, a size of the masked out portion is greater than the predetermined size of the buffer region.

6. The image forming system according to claim 4, wherein when the determined amount of advancement error corresponds to a correct advancement state, a size of the masked out portion is equal to the predetermined size of the buffer region.

7. The image forming system according to claim 4, wherein when the determined amount of advancement error corresponds to the over-advancement state, a size of the masked out portion is less than the predetermined size of the buffer region.

8. The image forming system according to claim 1, wherein the print unit subsequently prints the adjusted swath on the media adjacent to and after the print unit prints a corresponding preceding swath on the media, the printed adjusted swath having an effective swath height based on at least the determined amount of advancement error.

9. The image forming system according to claim 1, wherein the advancement error determination unit comprises:

at least one media advancement sensor to detect the advancement error of the media; and at least one error counter unit to count the amount of the advancement error.

10. The image forming system according to claim 8, wherein the corresponding preceding swath comprises a corresponding preceding unadjusted swath.

11. The image forming system according to claim 1, wherein the print unit comprises:

an inkjet print head.

12. A swath adjustment method, comprising:

printing a first swath by a print unit on a media;

advancing the media with respect to the print unit;

determining an amount of advancement error corresponding to the advancement of the media;

dynamically adjusting a swath size of a second swath to form an adjusted second swath; and printing the adjusted second swath by the print unit on the media having an effective swath height based on at least the determined amount of advancement error, wherein when the determined amount of advancement error is less than zero, dynamically adjusting the swath size of the second swath includes reducing the swath size to the effective swath height, and wherein when the determined amount of advancement error is greater than zero, dynamically adjusting the swath size of the second swath includes increasing the swath size to the effective swath height.

13. The method according to claim 12, wherein the dynamically adjusting a swath size of a second swath to form an adjusted second swath comprises:

dynamically increasing a swath height of the second swath by adding a buffer region having a predetermined size to the second swath to form the adjusted second swath; and dynamically applying a masked out portion to the adjusted second swath.

14. The method according to claim 13, wherein the adding the buffer region comprises:

duplicating a lower portion of the first swath of the predetermined size to an upper portion of the adjusted second swath in a form of a plurality of rows.

15. The method according to claim 14, wherein the masked out portion is based on the predetermined size of the buffer region and the determined amount of advancement error.

16. The method according to claim 15, wherein when the determined amount of advancement error is less than zero, a size of the masked out portion is greater than the predetermined size of the buffer region by an amount equal to an absolute value of the determined amount of advancement error.

17. The method according to claim 15, wherein when the determined amount of advancement error is equal to zero, a size of the masked out portion is equal to the predetermined size of the buffer region.

18. The method according to claim 15, wherein when the determined amount of advancement error is greater than zero, a size of the masked out portion is less than the predetermined size of the buffer region by an amount equal to the determined amount of advancement error.

19. The method according to claim 12, wherein the first swath comprises a preceding printed unadjusted swath, and the second swath comprises an adjacent subsequently printed adjusted swath.

20. A non-transitory computer-readable storage medium having embodied thereon a computer program to execute a method, wherein the method comprises:

printing an unadjusted first swath by a print unit on a media;

advancing the media with respect to the print unit;

determining an advancement error corresponding to the advancement of the media;

dynamically adjusting a swath height of a second swath to form an adjusted second swath; and printing the adjusted second swath by the print unit on the media adjacent the printed unadjusted first swath, the printed adjusted second swath having an effective swath height based on the advancement error, wherein with under-advancement, dynamically adjusting the swath height of the second swath includes reducing the swath height from an original swath height to the effective swath height, and wherein with over-advancement, dynamically adjusting the swath height of the second swath includes increasing the swath height from an original swath height to the effective swath height.

* * * * *

UNITED STATES PATENT AND TRADEMARK OFFICE

CERTIFICATE OF CORRECTION

PATENT NO. : 8,651,610 B2
APPLICATION NO. : 13/032875
DATED : February 18, 2014
INVENTOR(S) : Yngvar Rossow Sethne et al.

It is certified that error appears in the above-identified patent and that said Letters Patent is hereby corrected as shown below:

In the Claims

In column 8, line 28, in Claim 4, delete “apparatus” and insert -- system --, therefor.

Signed and Sealed this
Ninth Day of June, 2015

Michelle K. Lee

Michelle K. Lee
*Director of the United States Patent and Trademark Office*